US010480469B2

(12) United States Patent
Di Domizio et al.

(10) Patent No.: US 10,480,469 B2
(45) Date of Patent: Nov. 19, 2019

(54) COUPLING DEVICE

(71) Applicant: Continental Automotive GmbH, Hannover (DE)

(72) Inventors: Gisella Di Domizio, San Giuliano Terme (IT); Massimo Giovannetti, Scandicci (IT); Andrea Puccini, San Miniato (IT); Giandomenico Serra, Loc.Ghezzano-S.Giuliano Terme (IT)

(73) Assignee: CONTINENTAL AUTOMOTIVE GMBH, Hanover (DE)

( * ) Notice: Subject to any disclaimer, the term of this patent is extended or adjusted under 35 U.S.C. 154(b) by 255 days.

(21) Appl. No.: 13/965,604

(22) Filed: Aug. 13, 2013

(65) Prior Publication Data

US 2014/0041636 A1 Feb. 13, 2014

(30) Foreign Application Priority Data

Aug. 13, 2012 (EP) ..... 12180213

(51) Int. Cl.
*F02M 61/14* (2006.01)
*F02M 55/00* (2006.01)
*F02M 55/02* (2006.01)

(52) U.S. Cl.
CPC ..... *F02M 61/14* (2013.01); *F02M 55/005* (2013.01); *F02M 55/025* (2013.01); *F02M 2200/8061* (2013.01); *F02M 2200/8084* (2013.01)

(58) Field of Classification Search
CPC ..... F02M 2200/856; F02M 2200/853; Y10T 137/0491
USPC ..... 123/470, 456, 468
See application file for complete search history.

(56) References Cited

U.S. PATENT DOCUMENTS 4,500,488 A * 2/1985 Groh ..... G21C 3/04 376/409
5,258,599 A * 11/1993 Moerke ..... B23K 9/295 219/121.45
5,771,863 A * 6/1998 Daly ..... F02M 35/10072 123/184.61

(Continued)

FOREIGN PATENT DOCUMENTS

CN 2651457 Y 10/2004 ..... F02M 61/14
CN 101135286 A 3/2008 ..... F02M 61/14

(Continued)

OTHER PUBLICATIONS

European Search Report, Application No. 12180213.6, 5 pages, dated Jan. 9, 2013.

(Continued)

*Primary Examiner* — Long T Tran
*Assistant Examiner* — James J Kim
(74) *Attorney, Agent, or Firm* — Slayden Grubert Beard PLLC

(57) ABSTRACT

A coupling device is provided for hydraulically and mechanically coupling a fuel injector to a fuel rail of a combustion engine, the coupling device including a fuel injector cup configured to be coupled to the fuel rail and to engage a fuel inlet portion of the fuel injector, the fuel injector cup including a first part including a recess and a second part configured to be received in the recess of the first part and configured to engage the fuel inlet portion of the fuel injector.

15 Claims, 5 Drawing Sheets

(56) References Cited

U.S. PATENT DOCUMENTS 6,148,797 A * 11/2000 Gmelin ..... F02M 55/025 123/456
6,715,802 B2 * 4/2004 Baker ..... F16L 23/024 285/336
6,901,888 B2 * 6/2005 Baasch ..... F02M 25/00 123/1 A
6,978,765 B2 * 12/2005 Kilgore ..... F02M 55/025 123/456
7,810,471 B2 * 10/2010 Zdroik ..... 123/456
7,823,564 B2 * 11/2010 Edoardo et al. ..... 123/470
7,828,338 B2 * 11/2010 Kertesz ..... F16L 37/0987 285/252
7,874,282 B2 * 1/2011 Ghelardi ..... F02M 55/005 123/456
7,934,488 B2 * 5/2011 Biasci ..... F02M 55/025 123/470
2003/0062428 A1 * 4/2003 Baasch ..... F02M 25/00 239/407
2003/0080556 A1 * 5/2003 Kilgore ..... F02M 55/005 285/189
2007/0116734 A1 * 5/2007 Akash ..... A61F 2/30 424/423
2010/0258085 A1 * 10/2010 Giorgetti ..... F02M 55/02 123/470
2011/0108005 A1 * 5/2011 Nishizawa ..... F02M 55/025 123/469
2014/0231551 A1 * 8/2014 Serra ..... F02M 61/14 239/584

FOREIGN PATENT DOCUMENTS

CN 201284714 Y 8/2009 ..... F02M 61/14
CN 201891543 U 7/2011 ..... F02M 61/14
EP 0764485 A2 * 3/1997 ..... B22C 1/00
EP 1780403 A2 5/2007 ..... F02M 55/00
EP 2006530 A1 12/2008 ..... F02M 55/02
EP 2090772 A1 8/2009 ..... F02M 55/00

OTHER PUBLICATIONS

Chinese Office Action, Application No. 201310350391.5, 12 pages, dated Jun. 30, 2015.

* cited by examiner

COUPLING DEVICE

CROSS-REFERENCE TO RELATED APPLICATIONS

This application claims priority to EP Patent Application No. 12180213 filed Aug. 13, 2012. The contents of which is incorporated herein by reference in its entirety.

TECHNICAL FIELD

This disclosure relates to a coupling device for hydraulically and mechanically coupling a fuel injector to a fuel rail of a combustion engine.

BACKGROUND

Coupling devices for hydraulically and mechanically coupling a fuel injector to a fuel rail are in widespread use, in particular for internal combustion engines. Fuel can be supplied to an internal combustion engine by the fuel rail assembly through the fuel injector. The fuel injectors can be coupled to the fuel injector cups in different manners.

In order to keep pressure fluctuations during the operation of the internal combustion engine at a very low level, internal combustion engines are supplied with a fuel accumulator to which the fuel injectors are connected and which has a relatively large volume. Such a fuel accumulator is often referred to as a common rail.

Known fuel rails comprise a hollow body with recesses in form of fuel injector cups, in which the fuel injectors are received. The connection of the fuel injectors to the fuel injector cups that supply the fuel from a fuel tank via a low or high-pressure fuel pump needs to be very precise to get a correct injection angle and a sealing of the fuel.

SUMMARY

One embodiment provides a coupling device for hydraulically and mechanically coupling a fuel injector to a fuel rail of a combustion engine, the coupling device comprising a fuel injector cup being designed to be coupled to the fuel rail and to engage a fuel inlet portion of the fuel injector, the fuel injector cup comprising a first part comprising a recess, a second part being configured to be received in the recess of the first part and being designed to engage the fuel inlet portion of the fuel injector, wherein the second part has a porosity which is lower than the porosity of the first part.

In a further embodiment, the first and the second part comprise stainless steel.

In a further embodiment, the second part is configured to sealingly interact with a sealing of a fuel injector.

In a further embodiment, the second part is designed such that it provides a surface being configured to interact with the fuel injector.

In a further embodiment, the first part is manufactured by casting.

In a further embodiment, the second part is manufactured by machining, stamping or deep drawing.

In a further embodiment, the first part and the second part are connected by one or both of interference fitting or brazing.

Another embodiment provides a system comprising a coupling device as disclosed above, and a fuel injector comprising a fuel inlet portion and a sealing, wherein the sealing is in engagement with the fuel injector and with the second part of the coupling device such that the fuel inlet portion of the fuel injector is hydraulically coupled to the coupling device.

Another embodiment provides a method for manufacturing a coupling device for hydraulically and mechanically coupling a fuel injector to a fuel rail of a combustion engine, the method comprising the steps of providing a first part having a recess, providing a second part being configured to be received in the recess of the first part and comprising the step of inserting the second part in the recess of the first part wherein the second part has a porosity which is lower than the porosity of the first part.

In a further embodiment, the first and second parts comprise a metal and the first part is casted and/or the second part is machined, stamped or deep drawn.

In a further embodiment, the method further comprises casting the first part and machining, stamping or deep drawing the second part.

In a further embodiment, the method comprises the step of applying brazing material in at least one circumferential groove being provided in the first part at a contact interface between the first part and the second part before the second part is received in the first part.

In a further embodiment, the method comprises the step of applying brazing material on a contact interface between the first part and the second part via through-holes being provided in the first part.

In a further embodiment, the method comprises the step of heating the first part and the second part, thereby joining the first part and the second part.

In a further embodiment, the method comprises the step of heating the first part and the second part, thereby joining the first part and the second part.

Another embodiment provides a coupling device for hydraulically and mechanically coupling a fuel injector to a fuel rail of a combustion engine, the coupling device comprising a fuel injector cup being operable to couple to the fuel rail and to engage a fuel inlet portion of the fuel injector, the fuel injector cup comprising a first part comprising a recess, a second part being configured to be received in the recess of the first part and being operable to engage the fuel inlet portion of the fuel injector, wherein the first part has a multitude of voids and the fraction of the volume of said voids over the total volume of the first part is larger than a fraction of the volume of voids of the second part over a volume of the second part.

BRIEF DESCRIPTION OF THE DRAWINGS

Example embodiments of the invention are explained in the following with the aid of schematic drawings, in which.

DETAILED DESCRIPTION

Figure 1:
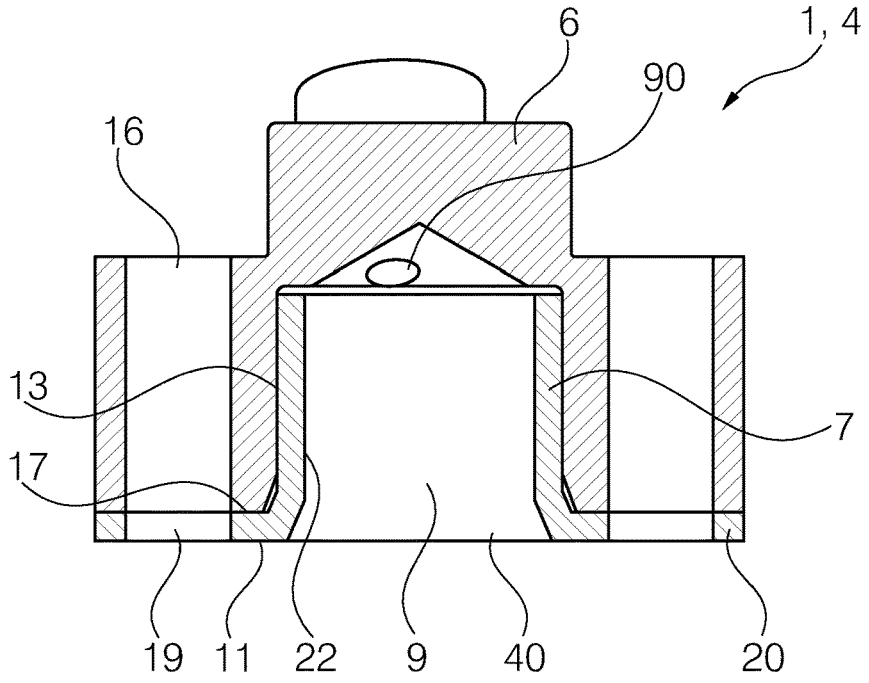
FIG. 1 shows a sectional view of a coupling device according to a first embodiment.

Some embodiments provide a coupling device for hydraulically and mechanically coupling a fuel injector to a fuel rail which is simple to be manufactured, cost-effective, and facilitates a reliable and precise connection between the fuel injector and the fuel injector cup.

For example, one embodiment provides a coupling device for hydraulically and mechanically coupling a fuel injector to a fuel rail of a combustion engine. The coupling device comprises a fuel injector cup. The fuel injector cup is expediently designed to be coupled to the fuel rail and to engage a fuel inlet portion of the fuel injector.

The fuel injector cup comprises a first part comprising a recess and a second part being configured to be received in the recess of the first part. The second part is expediently designed to engage the fuel inlet portion of the fuel injector. In particular, the second part has a hollow shape, for example a tubular shape.

According to one aspect of the present disclosure, the second part may have a porosity which is lower than the porosity of the first part. The porosity may sometimes also be called void fraction and is in particular the fraction of the volume of voids over the total volume of the respective part.

In one embodiment, first part and the second part each are metal parts, i.e. they comprise at least one metal or consist of at least one metal or alloy. In one development, the first and the second part are made from the same metal or alloy. The first part and/or the second part is/are made from stainless steel, for example.

In one embodiment, the first part may be designed as an external part, and the second part may be designed as an insert being configured to be inserted into the external part. The first part may line a surface of the recess of the second part.

In particular, the second part of the injector cup is configured to sealingly interact with a sealing of a fuel injector. For example, the sealing may be achieved by a sealing ring such as an o-ring which is positioned between the second part and the fuel injector.

Due to the low porosity of the second part, the second part may provide a smooth sealing surface. In particular, the porosity of the second part may be such that a satisfactory sealing function may be achieved. Thereby, a secure sealing of the fuel injector to the fuel injector cup is possible. As a result, the possibility of leak between the injector cup and the fuel injector may be reduced.

Porosity is a measure of void spaces in a material. For example, the void spaces in the first part may have a size of about 80 μm to 120 μm. The void spaces in the second part may be much smaller, for example 5 μm to 10 μm.

In one embodiment, the second part is designed such that it provides a surface being configured to interact with the fuel injector. For example, the second part may have a surface which represents apart of the bottom surface of the injector cup. In this case, a bottom surface of the first part may comprise a step, which is adapted to the form of the second part, such that after inserting the second part into the first part, a plane surface is achieved. This solution has the advantage that the second part is easy to manufacture.

In one development, the second part may extend—in particular completely—over the bottom surface of the injector cup. In other words, a surface of the second part represents the whole bottom surface. The bottom surface is in particular an end surface of the injector cup at its fuel outlet end. Preferably, it is perpendicular to a longitudinal axis of the injector cup.

This may have the advantage that no step, for example due to manufacturing tolerances, may occur on the bottom surface of the injector cup. Furthermore, the bottom surface may serve as a stop surface for the insertion of the second part. For example, the second part has a tubular shape with a flange, wherein a surface of the flange represents the bottom surface of the injector cup.

For example, the fuel injector may be mounted to the injector cup by a connection plate being mounted to the injector cup, in particular to the bottom surface of the injector cup. The bottom surface of the injector cup may be a reference plane to orient the connection plate of the fuel injector, and, as a consequence, the injector. With the second part extending over the whole bottom surface of the injector cup, a high planarity precision and an accurate injector orientation may be achieved. The connection plate may be fastened to the injector cup by two or more connection means, for example by screws. Alternatively, the fuel injector may be mounted to the injector cup by clamping means, for example by means of a spring clip. In this clamped application, the bottom surface of the injector cup may be the contact plane for the clamping means. Therefore, due to a high planarity precision of the bottom surface, a secure fastening of the fuel injector may be achieved.

According to one embodiment, the first part is manufactured by casting. The second part may be manufactured by machining, stamping or deep drawing. This has the advantage that the injector cup is easy to manufacture and has a high mechanical resistance, and also provides a sufficient sealing function.

Due to the different manufacturing process, the first and the second part may comprise different material properties. In particular, the first and the second part may have a different porosity.

According to one embodiment, the first part and the second part are connected by one or both of interference fitting or brazing. In particular, the first and second parts are configured to maintain a fixed position to each other by means of the connection. For example, the first part and the second part may be connected by press fitting or shrink fitting. Additionally or alternatively, the first part and the second part may be connected by brazing. The brazing material may be, for example, copper.

A brazed connection ensures that the first and the second part may not be displaced with respect to each other or disengage. Furthermore, a brazing joint may also seal the first part and the second part.

According to one embodiment, the first part may comprise one or more through-holes for applying brazing material. For example, the first part has a sidewall, the side wall extending in particular in a longitudinal direction of the injector cup, and the through-hole(s) extend obliquely or perpendicular to the longitudinal direction through the side wall. Via the through holes, the braze joint may be inspected after the brazing took place.

Additionally or alternatively, the first part may comprise at least one groove at the recess, in particular at the interface between the first part and the second part. The groove may serve as a seat for brazing material. Thereby, the distribution of the brazing material between the first and second part may be accurate and reproducible. By applying the brazing material via through holes or in one or more defined groove, brazing wetting or an overflow of brazing material into the fuel injector cup, in particular on the interior sealing surface of the fuel injector cup, may be inhibited.

According to a further aspect, a system comprising a coupling device, a fuel injector comprising a fuel inlet portion and a sealing is specified. The system is in particular a fuel rail assembly. It may expediently comprise a fuel rail such as a common rail.

The coupling device comprises a fuel injector cup. The fuel injector cup in particular has a first part comprising a recess and a second part being configured to be received in the recess of the first part and being designed to engage the fuel inlet portion of the fuel injector, wherein the second part has a porosity which is lower than the porosity of the first part. Preferably, the coupling device is designed as described above.

The sealing, for example the sealing ring, is in engagement with the fuel injector and with the second part of the coupling device such that the fuel inlet portion of the fuel injector is hydraulically coupled to the coupling device. In particular, the sealing may be engaged with an internal sealing surface of the second part.

According to yet another aspect, a method for providing a coupling device for hydraulically and mechanically coupling a fuel injector to a fuel rail of a combustion engine is specified. The method comprises the steps of providing a first part comprising a recess and providing a second part being configured to be received in the recess of the first part, wherein the second part has a porosity which is lower than the porosity of the first part, and comprising the step of inserting the second part in the recess of the first part.

According to one embodiment of the method, the first part is casted. According to a further embodiment of the method, the second part is machined, stamped or deep drawn.

According to one embodiment, the method comprises the step of applying brazing material on a contact interface between the first part and the second part via one or more through-holes being provided in the first part. For example, the through-holes may be provided on opposite sides in a wall of the first part. In particular, the brazing material may be applied via the through holes after the second part has been inserted into the first part. According to a further embodiment, the method comprises the step of applying brazing material in at least one circumferential groove being provided in the first part at a contact interface between the first part and the second part. In particular, the brazing material may be applied before the second part is received in the first part. After applying the brazing material in the groove, the second part may be inserted into the recess of the first part.

According to one embodiment, the method comprises the step of heating the first and the second part, thereby brazing and joining the first and the second part. For example, the parts may be heated in an oven.

Preferably, the method may serve to provide a coupling device as described previously.

FIG. 1 shows a sectional view of a first exemplary embodiment of a coupling device 1. The coupling device 1 comprises a fuel injector cup 4 comprising a first part 6 and a second part 7. Both parts 6, 7 are made from stainless steel. In particular, they are made from the stainless steel which is denoted by AISI 304 according to the nomenclature of the American Iron and Steel Institute. This steel is also suitable for the other embodiments of the coupling device.

The first part 6 is a casted part, while the second part 7 may be machined, stamped or deep drawn. Due to the different manufacturing process, the second part 7 may have a lower porosity than the first part 6.

The second part 7 is inserted in a recess 9 of the first part 6. The recess may open towards a fuel outlet end 40 of the injector cup 4. Opposite the opening at the fuel outlet end, the recess may have a bottom section with a fuel inlet opening 90. Advantageously, the second part 7 lines a surface, in particular an annular side surface, of the recess 9 at an interface 13 with the first part 6. In the present embodiment, the second part 7 has a generally tubular, hollow shape having a longitudinal axis.

The first part 6 and the second part 7 may be connected by brazing or by interference fitting—sometimes also denoted as press fitting or friction fitting—or by both. In particular, the first part 6 and the second part 7 are connected such that a relative movement between these two parts is avoided.

Adjacent to the recess 9 of the first part 6, two bores 16 are located. The bores 16 are provided for fastening a connector plate of a fuel injector to the fuel injector cup 4 (shown in FIG. 5).

The second part 7 extends over the bottom surface 17 of the first part 6. For example, the second part 7 has a flange 20 at one end. The bottom surface 17 and the flange are expediently located at the fuel outlet end 40. Thereby, the second part 7 provides a planar surface 11 being configured to align a fuel injector (not shown). The bottom surface 17 may serve as a stop surface for the insertion of the second part 7 into the recess 9 of the first part 6.

Figure 2:
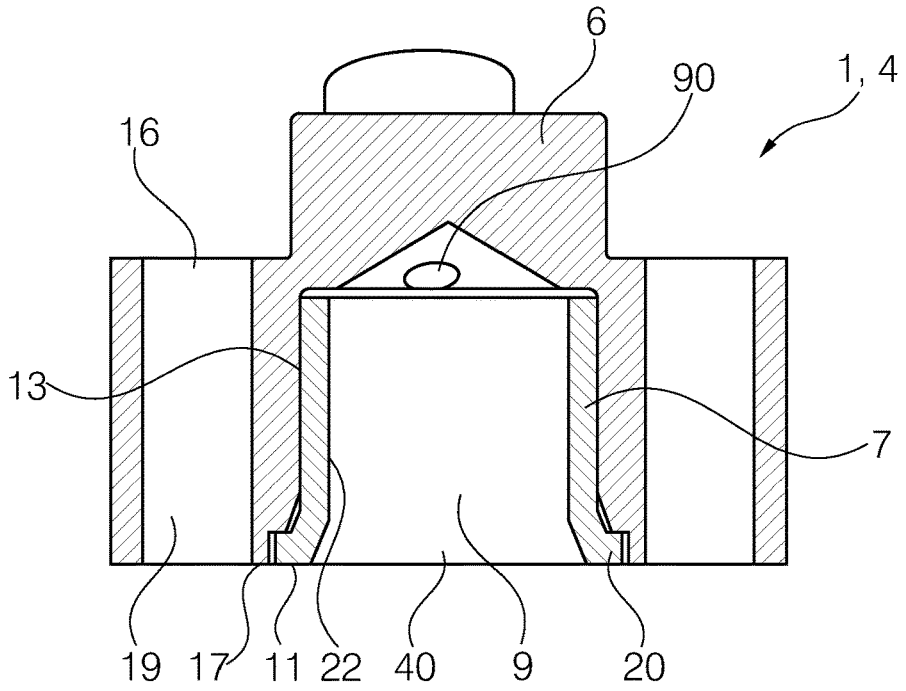
FIG. 2 shows a sectional view of a second embodiment of a coupling device.

The second part 7, in particular the flange of the second part 7, comprises bores 19 which are concentrically aligned to the bores 16 of the first part 6. When a fuel injector is mounted to the fuel injector cup 4, for example by screws being received in the bores 16 and 19, the second part 7 may be securely fastened to the first part 6. In this case, an interference fitting may be sufficient to connect the first part 6 and the second part 7. A brazing of the first part 6 and the second part 7 may be unnecessary. FIG. 2 shows a sectional view of a second exemplary embodiment of a coupling device 1. The coupling device is similar to the coupling device shown in FIG. 1, besides that the first part 6 and the second part 7 of the fuel injector cup 4 are shaped slightly different.

In particular, the second part 7 does not fully extend over the bottom surface 17 of the first part 6. In other words, the second part 7 partially exposes the bottom surface 17. Particularly, the second part 7 does not extend over the bores 16 of the first part 6. It comprises only a small collar 20 which serves as a stop for the insertion into the recess 9 of the first part 6. The first part 6 comprises a step which is adapted to the form of the second part 7, such that a planar surface 11 is provided at the bottom of the fuel injector cup 4. The second part 7 shown in FIG. 2 may be easy to manufacture, particularly because it does not comprise any bores.

Figure 3:
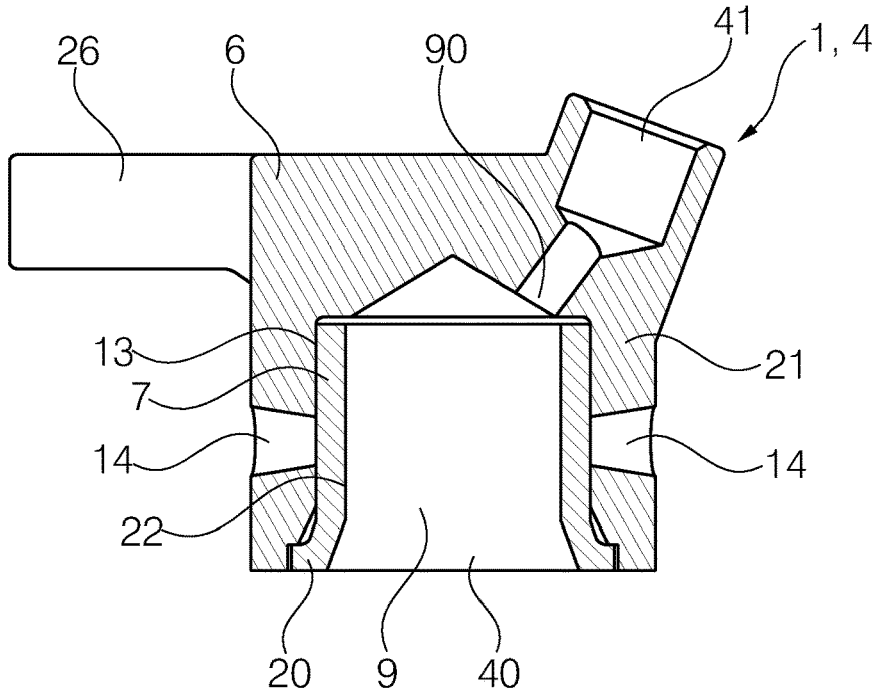
FIG. 3 shows a sectional view of a third embodiment of a coupling device, the coupling device having through-holes.

FIG. 3 shows a sectional view of a coupling device 1 according to a third embodiment. The coupling device may have a cross-section as the coupling device 1 of the second embodiment described in connection with FIG. 2. For example, FIG. 3 may show the coupling device 1 rotated about 90 degrees with respect to the view of FIG. 2. As best seen in FIG. 3, the fuel inlet opening 90 of the recess 9 is hydraulically coupled to a fuel inlet 41 of the injector cup 4.

There are two through-holes 14 located in a wall 21 of the first part 6. The through-holes 14 may be omitted in the coupling device of the second embodiment, for example when the first and second parts 6, 7 are coupled by friction fitting.

The through-holes 14 are provided for applying brazing material between the first part 6 and the second part 7, in particular on an interface 13 between the first part 6 and the second part 7. By means of the through-holes 14, brazing wetting or an overflow of brazing material on an interior surface 22 of the second part 7 may be inhibited. Furthermore, after the brazing has occurred, the brazing joint may be inspected via the through-holes 14.

In the present embodiment, the coupling device 1 has a lug 26. The lug 26 may be formed integrally with the first part 6, for example. It is in particular provided for establishing a—preferably rigid—mechanical connection between the injector cup 4 and cylinder head (not shown), for example of an internal combustion engine. The lug 26 may have a hole for receiving a screw, for example (see FIG. 5B). The lug 26 may also be useful for other embodiments of the coupling device.

Figure 4:
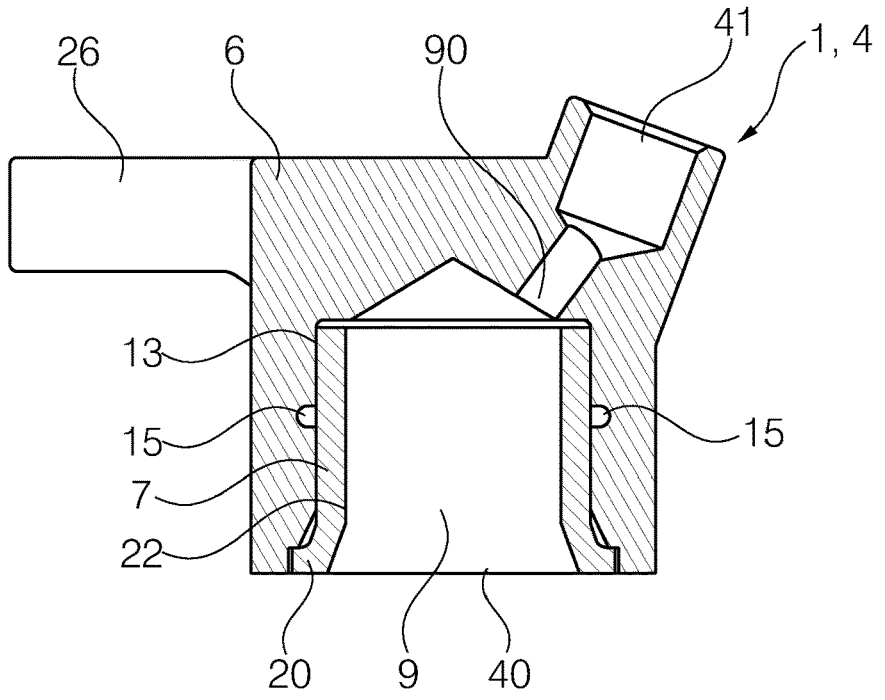
FIG. 4 shows a sectional view of a fourth embodiment of a coupling device, the coupling device having a circumferential groove in the first part.

FIG. 4 shows a sectional view of a coupling device 1 according to a fourth embodiment. The coupling device may have a cross-section as the coupling device 1 of the second embodiment described in connection with FIG. 2. For example, FIG. 4 may show the coupling device 1 rotated about 90 degrees around the longitudinal axis with respect to FIG. 2.

In the present embodiment, the first part 6 comprises a circumferential groove 15 at the interface 13 between the first part 6 and the second part 7. This groove 15 is provided to serve as a seat for the brazing material. The brazing material may be applied into the groove 15 before the second part 7 is inserted into the first part 6. By applying the brazing material into the circumferential groove 15, it may be ensured that the brazing material is evenly distributed around the interface 13 between the first part 6 and the second part 7. Thereby, the quality of the brazing joint may be precise and reproducible.

Figure 5A:
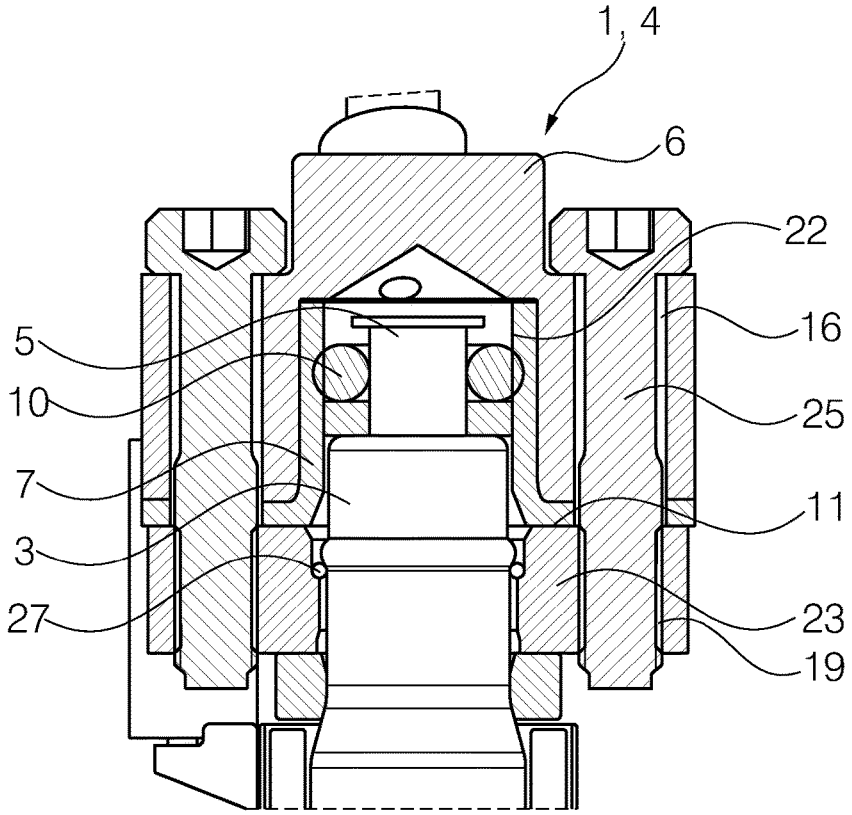
FIG. 5A shows a sectional view of a system comprising a coupling device.
Figure 5B:
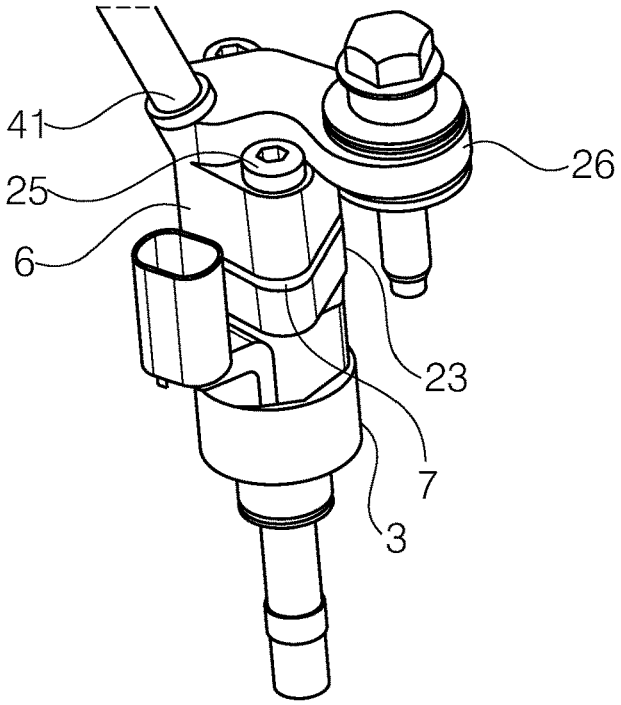
FIG. 5B shows the system of FIG. 5A in a perspective view.

FIGS. 5A and 5B show a system comprising a coupling device 1 and a fuel injector 3 in a sectional view and in a perspective view, respectively. For example, the system may comprise the coupling device shown in FIG. 1.

The fuel injector 3 is mounted to the fuel injector cup 4 of the coupling device 1 via a connection plate 23. The connection plate 23 is aligned at the surface 11 of the injector cup 4, in particular of the second part 7, and fastened by means of two screws 25 being inserted through the bores 16, 19 of the first part 6 and the second part 7. The connection plate 23 and the fuel injector 3 may mechanically interact—for example by means of a wire ring or a snap ring 27—to block axial movement of the injector 3 with respect to the connection plate 23 at least in one axial direction. In this way, the connection plate 23 is in particular provided for positionally locking the fuel injector 3 in the recess 9.

A sealing 10, in particular an o-ring, is located around the fuel injector 3. The sealing 10 is in engagement with the interior surface 22 of the second part 7. Due to the low porosity of the second part 7, a satisfactory sealing may be achieved between the injector cup 4 and the fuel injector 3. Thereby, a fuel inlet portion 5 of the fuel injector 3 may be hydraulically coupled to the injector cup 4.

Figure 6:
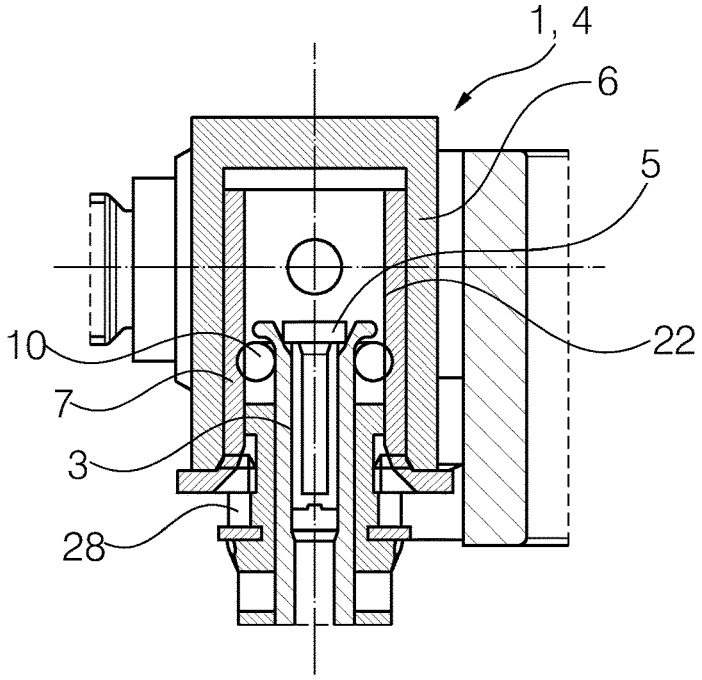
FIG. 6 shows a sectional view of a further system comprising a coupling device.

FIG. 6 shows a further system comprising a coupling device 1. For example, the system may comprise the coupling device 1 shown in FIG. 2. The system is similar to the system explained in connection with FIGS. 5A and 5B regarding the sealing between the fuel injector cup 4 and the fuel injector 3. It only differs in the kind of mounting of the fuel injector 3 to the fuel injector cup. In FIG. 6, the fuel injector 3 is clamped to the fuel injector cup 4, for example by a spring clip 28. Therefore, no bores are required in the fuel injector cup 4.

Figure 7:
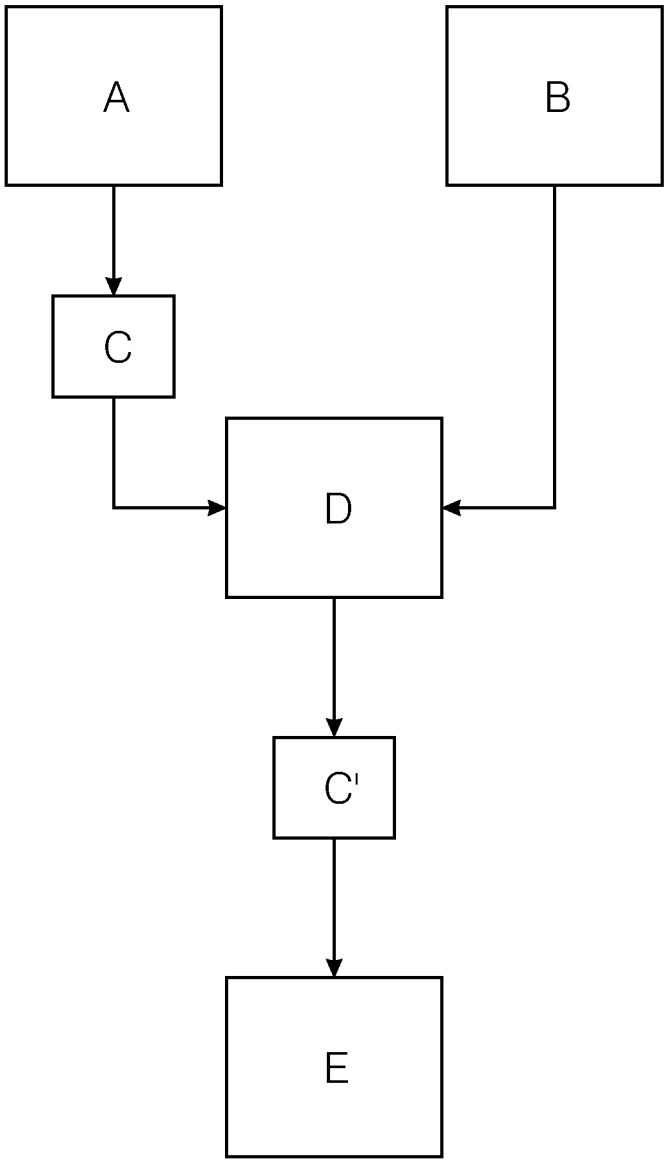
FIG. 7 is a schematic representation of a method for providing a coupling device.

FIG. 7 shows a schematic representation of a method for providing a coupling device 1. In a step A, the first part of the coupling device may be manufactured by casting. The first part may comprise a recess for receiving a second part. In a step B, the second part may be manufactured by machining, stamping or deep drawing. Due to the manufacturing process, the second part may have a lower porosity than the first part.

In one embodiment of the method, brazing material may be applied in a circumferential groove of the first part in step C. The circumferential groove may be located in the recess of the first part.

In a subsequent step D, the second part may be inserted into the recess of the first part.

In one embodiment, additionally or alternatively to step C, brazing material may be applied on an interface between the first part and the second part in a step C', after the second part has been inserted into the recess of the first part. For example, brazing material may be applied via through-holes in a wall of the first part.

Afterwards, in a step E, the first part and the second part may be connected by brazing. For example, the parts may be heated in an oven.

In a further embodiment, the first and the second part may be connected only by interference fitting without brazing.

With this method, for example a coupling device according to any of FIGS. 1 to 4 may be provided.

The invention is not limited to specific embodiments by the description on the basis of said exemplary embodiments but comprises any combination of elements of different embodiments. Moreover, the invention comprises any combination of claims and any combination of features disclosed by the claims.

What is claimed is:

1. A fuel injector cup for hydraulically and mechanically coupling a fuel injector to a fuel rail of a combustion engine, the fuel injector cup comprising:

a first part having a top end and a bottom end, the top end comprising a fuel inlet of the injector cup, the bottom end comprising a first recess, the first part further comprising two first bores for connecting a connector plate of the fuel injector to the fuel injector cup, and a second part including (a) a body portion received in the first recess of the first part and defining a second recess and (b) a flange portion extending outwardly from the second part body and comprising two second bores aligning with the two first bores of the first part when the second part is received in the recess of the first part, the second part configured to receive the fuel inlet portion of the fuel injector, wherein the second recess of the second part is located in the first recess of the first part such that the fuel inlet portion of the fuel injector received in the second recess of the second part is also located in the first recess of the first part, wherein the first part is a cast metal part, the second part is a machined, stamped, or deep-drawn metal part, and a press-fit or shrink-fit connection and/or a brazed connection between the first and second parts, and two threaded connectors, each extending through one of the first bores in the first part, one of the second bores in the second part, and an opening in the connector plate of the fuel injector to both (a) secure the second part to the first part and (b) secure the fuel injector to the first and second parts of the fuel injector cup.

2. A fuel injector cup according to claim 1, wherein the first part and the second part each comprise stainless steel.

3. A fuel injector cup according to claim 1, wherein the second part is configured to seemingly interact with a sealing of a fuel injector.

4. A fuel injector cup according to claim 1, wherein the second part provides a surface configured to interact with the fuel injector.

5. A system comprising:

a fuel injector cup configured to be coupled to a fuel rail and comprising:

a first part having a top end and a bottom end, the top end comprising a fuel inlet of the injector cup, the bottom end comprising a recess, and a second part received in the recess of the first part, and when received in the first part, lining at least an entire wall of the recess and fitting flush into the recess, wherein the second part comprises a second material with a second porosity and the first part comprises a first material with a first porosity, wherein the first porosity defines void spaces having a size of about 80-120 μm and the second porosity is lower than the first porosity and defines void spaces having a size of about 5-10 μm and wherein the lower second porosity of the second part defines a smooth surface of the second part, and a fuel injector comprising a fuel inlet portion and a sealing portion, wherein the sealing portion engages the smooth surface of the second part of the fuel injector cup to provide a secure sealing between the fuel injector and the second part to hydraulically couple the fuel inlet portion of the fuel injector to the fuel injector cup.

6. A method for assembling a coupling device for hydraulically and mechanically coupling a fuel injector to a fuel rail of a combustion engine, the method comprising:

providing a first part having a top end and a bottom end, the top end comprising a fuel inlet of the injector cup, the bottom end having a recess, the first part further comprising two first bores for connecting a connector plate of the fuel injector to the fuel injector cup, providing a second part including (a) a body portion configured to be received in the recess of the bottom end of the first part, and (b) a flange portion extending outwardly from the second part body and defining a planar bottom surface configured for flush engagement with a planar surface of a connector plate for securing the fuel injector to the coupling device, wherein two second bores are formed in the planar bottom surface, the two second bores aligning with the two first bores of the first part when the second part is received in the recess of the first part, and inserting the second part in the recess of the first part so that the second part lines at least walls of the recess, wherein a porosity of the second part is lower than a porosity of the first part.

7. A method according to claim 6, comprising forming each of the first and second parts from a metal.

8. A method according to claim 7, further comprising casting the first part and machining, stamping, or deep drawing the second part.

9. A method according to claim 6, further comprising at least one circumferential groove on the first part at a contact interface between the first part and the second part.

10. A method according to claim 6, further comprising through-holes in the first part.

11. A method according to claim 9, comprising heating the first part and the second part to join the first part and the second part.

12. A method according to claim 10, comprising heating the first part and the second part to join the first part and the second part.

13. A fuel injector cup for hydraulically and mechanically coupling a fuel injector to a fuel rail of a combustion engine, the fuel injector cup comprising:

a first part having a top end and a bottom end, the top end comprising a fuel inlet of the injector cup, the bottom end comprising a recess, and a second part received in and lining at least walls of the recess, the second part configured to receive the fuel inlet portion of the fuel injector, wherein the first part comprises cast stainless steel, the second part comprises a machined, stamped, or deep-drawn stainless steel having a tubular shape with a flange, and a press-fit or shrink-fit connection and/or a brazed connection between the first and second parts, wherein the stainless steel of the second part has a second porosity and the cast stainless steel first part comprises a first material with a first porosity, and the first porosity is higher than the second porosity, wherein the first porosity defines void spaces having a size of about 80-120 μm and the second porosity defines void spaces having a size of about 5-10 μm, wherein the lower second porosity of the stainless steel second part defines a smooth surface of the second part for providing a secure sealing when engaged with a respective surface of the fuel injector received in the second part.

14. The system of claim 5, wherein:

the first part further comprises two bores for connecting a connector plate of the fuel injector to the fuel injector cup, and the second part further comprises two bores aligning with the two bores of the first part when the second part is received in the recess of the first part.

15. The fuel injector cup of claim 13, wherein:

the first part further comprises two bores for connecting a connector plate of the fuel injector to the fuel injector cup, and the second part further comprises two bores aligning with the two bores of the first part when the second part is received in the recess of the first part.

* * * * *